US006484354B2

(12) United States Patent
Lee

(10) Patent No.: US 6,484,354 B2
(45) Date of Patent: Nov. 26, 2002

(54) AIR CIRCULATION TYPE VACUUM CLEANER

(75) Inventor: Seong Bin Lee, Siheung (KR)

(73) Assignee: LG Electronics Inc., Seoul (KR)

( * ) Notice: Subject to any disclaimer, the term of this patent is extended or adjusted under 35 U.S.C. 154(b) by 36 days.

(21) Appl. No.: 09/740,851

(22) Filed: Dec. 21, 2000

(65) Prior Publication Data

US 2001/0027585 A1 Oct. 11, 2001

(30) Foreign Application Priority Data

Apr. 6, 2000 (KR) ..... 00-17879

(51) Int. Cl.[7] ..... A47L 7/04; A47L 9/02; A47L 9/08

(52) U.S. Cl. ..... 15/346; 15/409

(58) Field of Search ..... 15/345, 346, 350, 15/409

(56) References Cited

U.S. PATENT DOCUMENTS 1,281,925 A * 10/1918 Farnsworth
4,393,536 A * 7/1983 Tapp
4,884,315 A * 12/1989 Ehnert
5,088,860 A 2/1992 Stockdale et al.
5,167,046 A 12/1992 Benson
5,502,872 A * 4/1996 Chae et al.
5,647,092 A * 7/1997 Miwa
5,930,864 A * 8/1999 Inoue et al.
6,032,327 A * 3/2000 Oka et al.

FOREIGN PATENT DOCUMENTS

DE 144748 A 11/1980
DE 4140630 C1 2/1993
GB 2270463 A 3/1994

* cited by examiner

*Primary Examiner*—Terrence R. Till
(74) *Attorney, Agent, or Firm*—Fleshner & Kim, LLP

(57) ABSTRACT

An air circulation type vacuum cleaner having a casing with a suction port and an exhaust port, a suction blower placed to intake air with impurities through the suction port, a suction fan having a dust collecting filter placed on the outlet side of the suction blower to filter the impurities from the air. The vacuum cleaner also has at least one reflux pipe with an inlet portion placed on an outlet side of the suction fan in order to return the air discharged from the suction fan to an inlet side of the suction fan and at least one ejector installed on an outlet side of the reflux pipe. The suction force generated by the suction fan and the suction force generated by the vacuum pressure from the redirection of air in the reflux pipe are used together to improve the suction ability of the vacuum cleaner.

25 Claims, 8 Drawing Sheets

AIR CIRCULATION TYPE VACUUM CLEANER

BACKGROUND OF THE INVENTION

1. Field of the Invention

The present invention relates to a flow channel system of a vacuum cleaner, in particular to an air circulation type vacuum cleaner which is capable of doubling suction force besides suction force of a suction fan by circulating discharged air to the suction side again and inducing vacuum pressure on the suction side.

2. Description of the Prior Art

In the general vacuum cleaner, an one-direction suction method for sucking dusts by using only suction force generated by a suction fan is mainly used, in this case because a bottom surface of a suction blower is adsorbed to a surface to be cleaned, suction ability of the vacuum cleaner lowers a lot. In the consideration of the problem, an air circulation method (Re: Japan patent official bulletin No. 31-62814) is represented, the method refluxes part of the air wind generated by the suction fan to the suction blower again, jets it with a certain pressure, and sucks the dusts while blowing the dusts.

As described above, in the air circulation method, because the air wind circulated from the suction fan has to blow the dusts on the bottom surface to be cleaned with a certain discharge pressure and suck the dusts with a certain suction pressure, the air circulation type vacuum cleaner has a problem to control discharge pressure of circulation air and suction pressure of the suction fan. In addition, because sectional area of the suction blower lengthens by expanding the reflux flow channel of the air from the discharge side of the blow fan to the suction blower, the conventional air circulation type vacuum cleaner has a problem to clean narrow place. Therefore, the conventional one-directional suction type vacuum cleaner is used in general.

FIG.1 is a schematic view illustrating a flow channel system of the conventional one-bodied vacuum cleaner adapting the one-directional suction method.

As depicted in FIG.1, the conventional one-directional suction type one-bodied vacuum cleaner comprises a casing 1 having a suction port (no reference numeral) and an exhaust port (no reference numeral) on the both upper and lower ends, a suction blower 2 placed so as to be consecutive to the suction port side inside of the casing 1 in order to suck impurities with surrounding air, a dust collect filter 3 placed so as to be consecutive to an outlet side of the suction blower 2 in order to filter the impurities included in the sucked air, a suction fan 4 placed so as to be consecutive to the outlet side of the dust collect filter 4 in order to generate the suction force, and a fan motor 5 placed so as to be consecutive to the discharge side of the suction fan 4 in order to generate the operating force for rotating the suction fan 4.

The suction blower 2 is formed as a frustum conical shape getting narrower toward the outlet. The dust collect filter 3 is formed so as to make its crosssectional area include the outlet side of the suction blower 2, and the suction fan 4 is a centrifugal fan having a diffuser used in general in the vacuum cleaner.

In the flow channel system of the conventional one-bodied vacuum cleaner, the suction fan 4 generates the suction force while rotating by the operation of the fan motor 5, the suction force is transmitted to the inlet side of the suction blower 2 after passing through the dust collect filter 3, and sucks the impurities on the place to be cleaned with the air.

After that, the air sucked to the suction blower 2 passes the dust collect filter 3 consecutively placed to the suction blower 2, during the process the impurities are left by being filtered by the dust collect filter 3, the air directly passes the dust collect filter 3, is sucked to the inlet side of the suction fan 4, is discharged through the diffuser (not shown), cools the fan motor 5 consecutively placed to the discharge side of the suction fan 4, and is discharged to the outside of the vacuum cleaner through a ventilation hole (not shown) of the casing 1 placed on the rear side of the fan motor 5.

However, in the structure of the flow system of the conventional one-bodied vacuum cleaner, the air and impurities are sucked together by the suction force of the suction fan 4 transmitted to the inlet side of the suction blower 2 by the operation of the fan motor 5, when the suction force generated from the suction fan 4 is small, the ability of the vacuum cleaner lowers, in the consideration of it when the suction force increases by increasing the capacity of the fan motor 5, the power consumption increases and the discharge noise in proportion to the rotating speed of the suction fan 4 increases together.

SUMMARY OF THE INVENTION

In order to solve above-mentioned problem of a flow channel system of the conventional one-bodied vacuum cleaner, the object of the present invention is to provide a vacuum cleaner which is capable of doubling suction force for sucking impurities with dusts while keeping capacity of a fan motor as same.

In order to achieve the object of the present invention, the air circulation type vacuum cleaner according to the present invention comprises a casing having a suction port and an exhaust port separately, a suction blower placed so as to be consecutive to the suction port of the casing in order to suck impurities with surrounding air, a suction fan having a dust collect filter placed so as to be consecutive to the outlet side of the suction blower in order to filter the impurities from the sucked air and a fan motor for generating suction force, at least one reflux pipe arranged its inlet portion is placed on the discharge side of the suction fan having the fan motor in order to return the discharge air discharged from the suction fan to the suction side, and at least one ejector installed on the outlet side of the reflux pipe in order to jet the discharge air with high speed.

DETAILED DESCRIPTION OF THE PREFERRED EMBODIMENT

Hereinafter, an air circulation type vacuum cleaner according to the embodiment of the present invention will now be described with reference to accompanying drawings.

Figure 1:
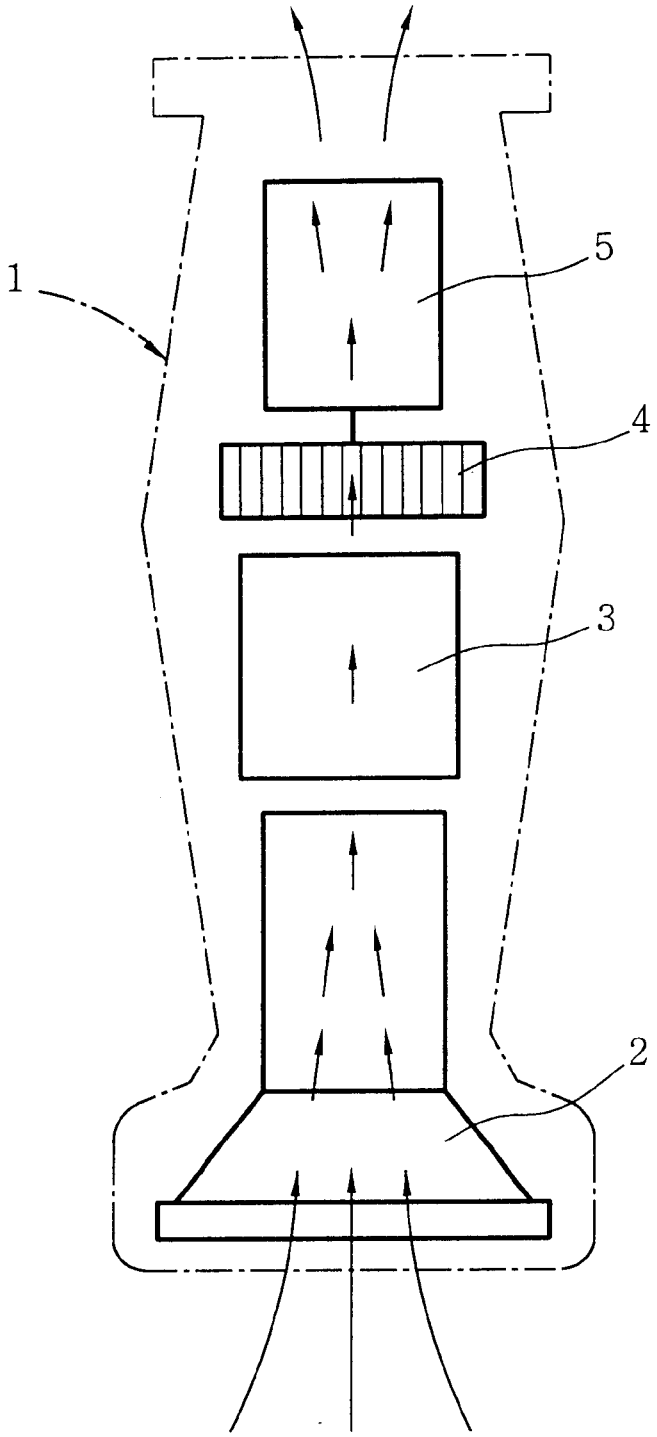
FIG. 1 CONVENTIONAL ART
FIG. 1 is a schematic view illustrating a flow channel system of the conventional one-bodied vacuum cleaner.
Figure 2:
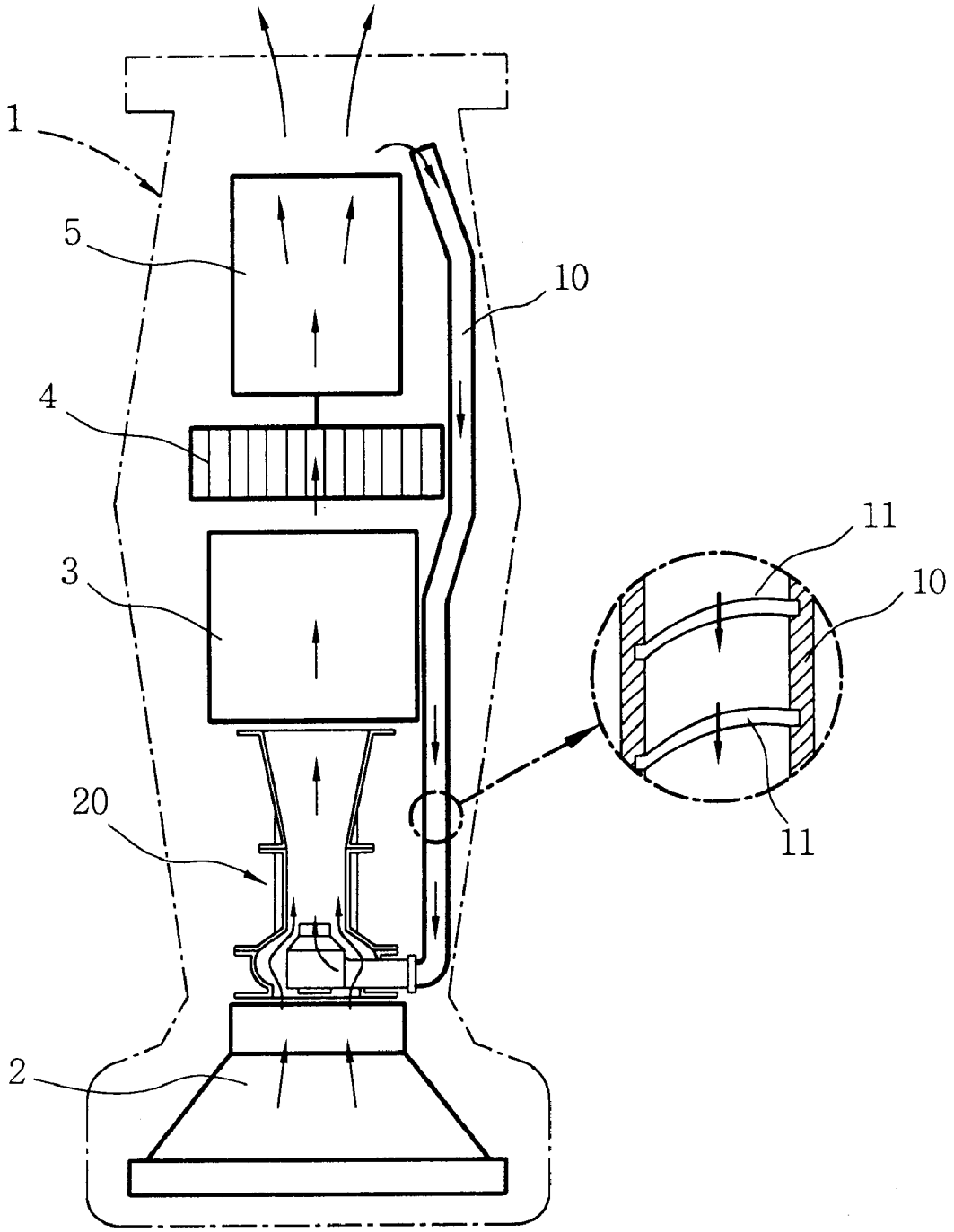
FIG. 2 is a schematic view illustrating a flow channel system of an one-bodied vacuum cleaner according to the embodiment of the present invention.
Figure 3:
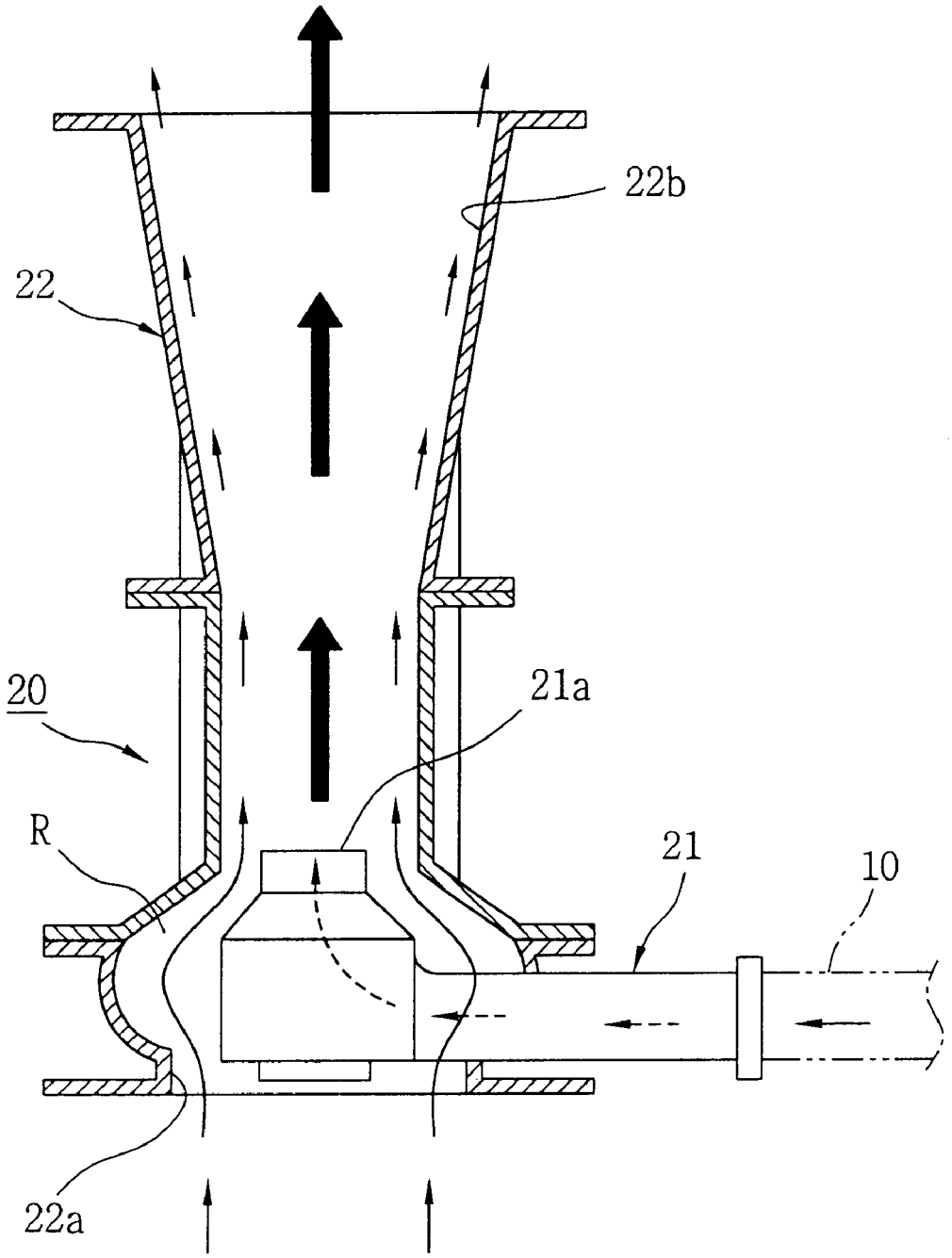
FIG. 3 is a profile illustrating an ejector of the one-bodied vacuum cleaner according to the present invention.

FIG. 2 is a schematic view illustrating a flow channel system of an one-bodied vacuum cleaner according to the embodiment of the present invention. FIG. 3 is a profile illustrating an ejector of the one-bodied vacuum cleaner according to the present invention.

As depicted in FIGS. 2 and 3, the air circulation one-bodied vacuum cleaner according to the present invention comprises a casing 1 having a suction port (no reference numeral) on the lower end and an exhaust port (no reference numeral) on the upper end, a suction blower 2 placed inside of the casing 1 so as to be consecutive to the suction port of the casing 1 in order to suck impurities with surrounding air, a dust collect filter 3 placed so as to be consecutive to the outlet side of the suction blower 2 in order to filter the impurities from the sucked air, a suction fan 4 placed on the straight line so as to be consecutive to the outlet side of the dust collect filter 3 in order to generate suction force for sucking the impurities with air, a fan motor 5 for operating the suction fan 4, a reflux pipe 10 arranged its inlet end is placed on the outlet side of the suction fan 4 in order to return the air discharged from the suction fan 4 to the inlet side and its outlet end is placed between the suction blower 2 and dust collect filter 3, and an ejector 20 connected with the outlet end of the reflux pipe 10 in order to jet the returned air as high speed to the same direction with outer air.

The suction blower 2 is formed as a frustum conical shape so as to be narrower toward the outlet. The dust collect filter 3 is formed so as to make its crosssectional area include the outlet side of the suction blower 2, and the suction fan 4 is a centrifugal fan having a diffuser used in general in the vacuum cleaner.

The diffuser (not shown) is installed around the suction fan 4 in order to make the discharged air have pressure energy by surrounding the fan wing (no reference numeral) and at the same time make the discharged air flow to the fan motor 5.

As depicted in FIG. 2, it is advisable to form the reflux pipe 10 as a plain pipe having same diameter in order to minimize flow resistance, but it is also advisable to form the reflux pipe 10 so the diameter of the pipe becomes gradually smaller from the inlet end to the outlet end.

In addition, as depicted in FIG. 2, it is advisable to form a flow channel groove 11 having a spiral shape on the inner circumference of the reflux pipe 10 in order to clean inside of the pipe by the air circulating inside of the reflux pipe 10 as the spiral shape.

As depicted in FIG. 3, the ejector 20 comprises an ejector nozzle 21 installed so as to get its discharge end 21*a* consecutive to the outlet end of the reflux pipe 10 toward same direction with the inlet flow channel of the sucker air, and an ejector diffuser 22 installed so as to accept the ejector nozzle 21 by having an air flow channel R between the outlet side of the suction blower 2 and inlet side of the dust collect filter 3.

Parts overlapped with the conventional technology will have same reference numerals.

An non-described reference numeral 22*a* is an inlet end of the ejector diffuser, and 22*b* is an outlet end of the ejector diffuser.

The general operation of the one-bodied air circulation vacuum cleaner according to the present invention is similar with the conventional technology.

In other words, the suction force is generated while the suction fan 4 rotates by the operation of the fan motor 5, the suction force is transmitted to the inlet side of the suction blower 2 through the dust collect filter 3, and sucks the impurities on the place to be cleaned with the air.

After that, the air sucked into the suction blower 2 passes the dust collect filter 3 placed so as to be consecutive to the suction blower 2 with the air, during the process the dusts are filtered by the dust collect filter 3, however the air passes the dust collect filter 3, is sucked into the inlet side of the suction fan 4, passes the diffuser (not shown) of the suction fan 4, is discharged to the fan motor 5, the air cools the fan motor 5, part of the air is discharged to the external of the vacuum cleaner through the exhaust port (no reference numeral) of the casing 1, the rest of the air is sucked into the reflux pipe 10 and circulates.

Herein, the air sucked into the reflux pipe 10 is induced between the suction blower 2 and dust collect filter 3 along the reflux pipe 10 as suppressed state, is jetted as high speed to the same direction with the sucked air through the ejector nozzle 21, vacuum state is partially formed around the ejector nozzle 21, according to this, the genuine suction force by the suction fan 4 and suction force by the vacuum pressure are added, accordingly the total suction force about the outer air and impurities increases, and the suction ability of the vacuum cleaner having same motor capacity can increase a lot.

In addition, the total suction force of the vacuum cleaner increases by using the reflux pipe 10 for returning the discharged air into the inlet side of the suction fan 4 and the ejector 20 for jetting the returned high pressure discharge gas as high speed, accordingly the present invention can minimize the manufacture cost increase due to the efficiency improvement of the vacuum cleaner or maintenance cost increase due to mishaps because the structure of the present invention is simple and easy to use.

In addition, there is no need to extend the reflux pipe 10 to the suction blower 2, in particular when the present invention is adapted to a chargeable small vacuum cleaner which has weak suction force and is suitable to clean small place, the suction force improves a lot, but the longitudinal dimension of the suction blower 2 does not increase, accordingly the chargeable small vacuum cleaner can maintain its size with improved cleaning power and it can clean every nook and corner of narrow place.

As the present invention may be embodied in several forms without departing from the spirit or essential characteristics thereof, it should also be understood that the above-described embodiments are not limited by any of the details of the foregoing description, unless otherwise specified, but rather should be constructed broadly within its sprit and scope as defined in the appended claims, and therefore all changes and modifications that fall within the meets and bounds of the claims, or equivalence of such meets and bounds are therefore intended to be embraced by the appended claims.

Figure 4:
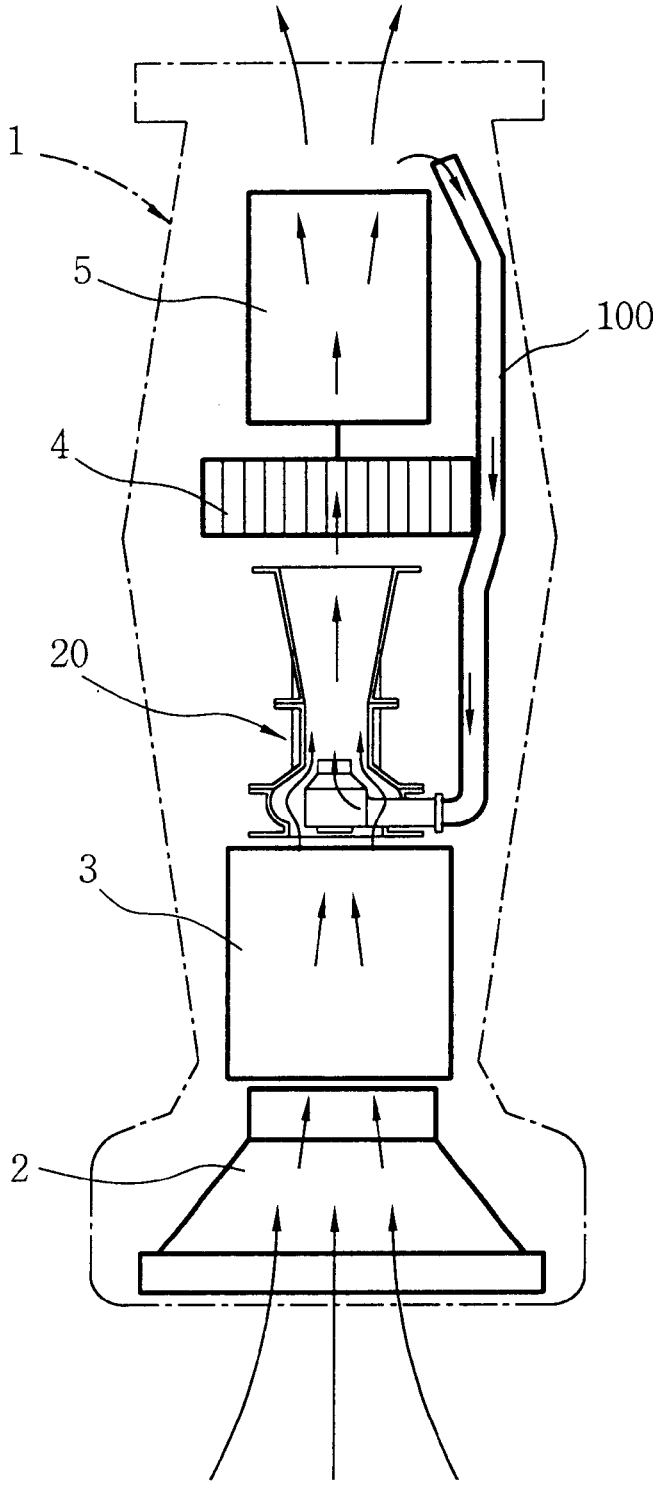
FIG. 4 is a schematic view illustrating the other embodiment of the flow channel system of the one-bodied vacuum cleaner according to the present invention.

For example, as depicted in FIG. 4, in the other embodiment of the present invention, when the suction fan 4 including the suction blower 2, dust collect filter 3, and fan motor 5 is placed consecutively inside of the casing 1, the inlet end of the reflux pipe 100 is placed on the discharge side of the suction fan 4, the ejector 20 arranged on the outlet end of the reflux pipe 100 can be placed between the dust collect filter 3 and suction fan 4, in this case the pressure lowering problem of the returned air can be prevented as a certain degree because the length of the reflux pipe 100 is shorter than the embodiment of the present invention.

Figure 5:
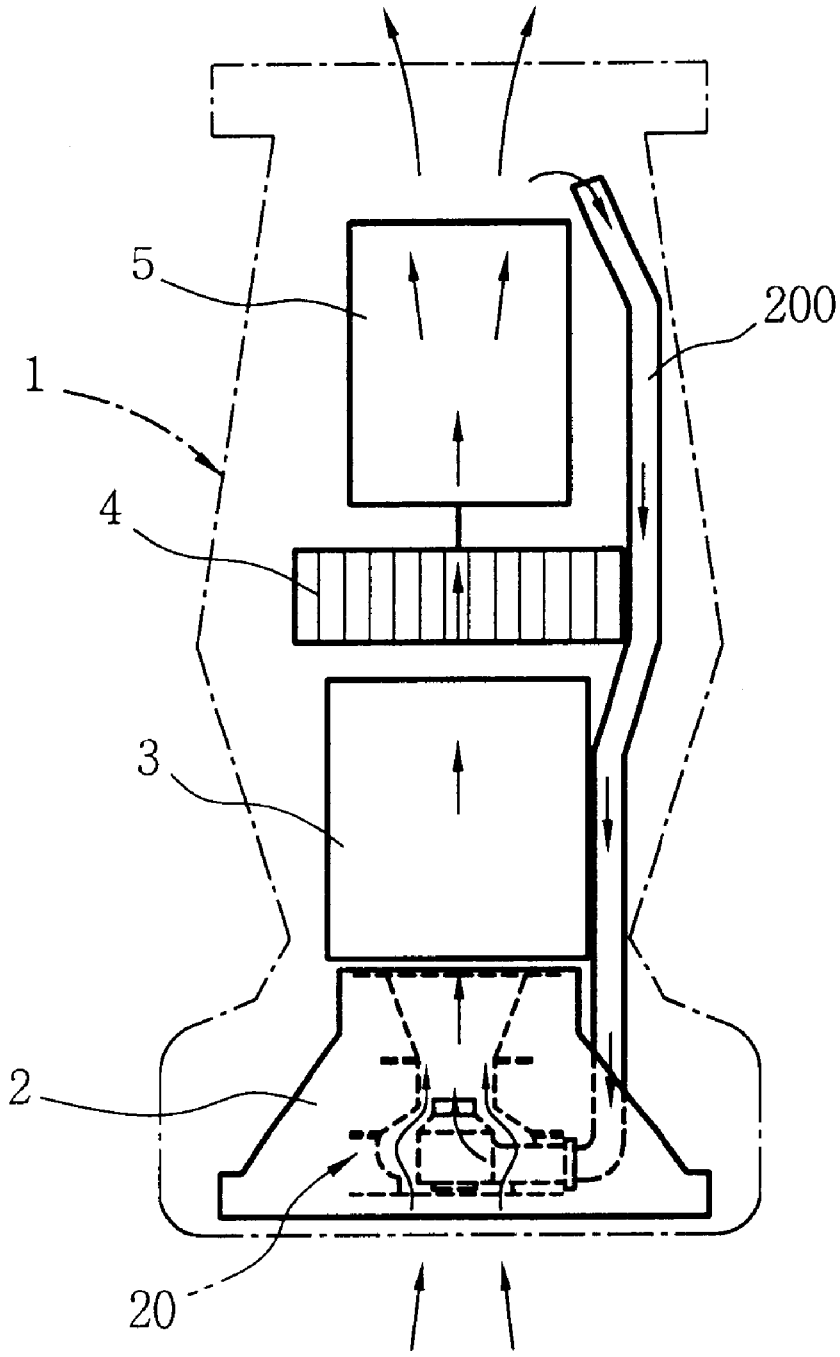
FIG. 5 is a schematic view illustrating the another embodiment of the flow channel system of the one-bodied vacuum cleaner according to the present invention.
Figure 6:
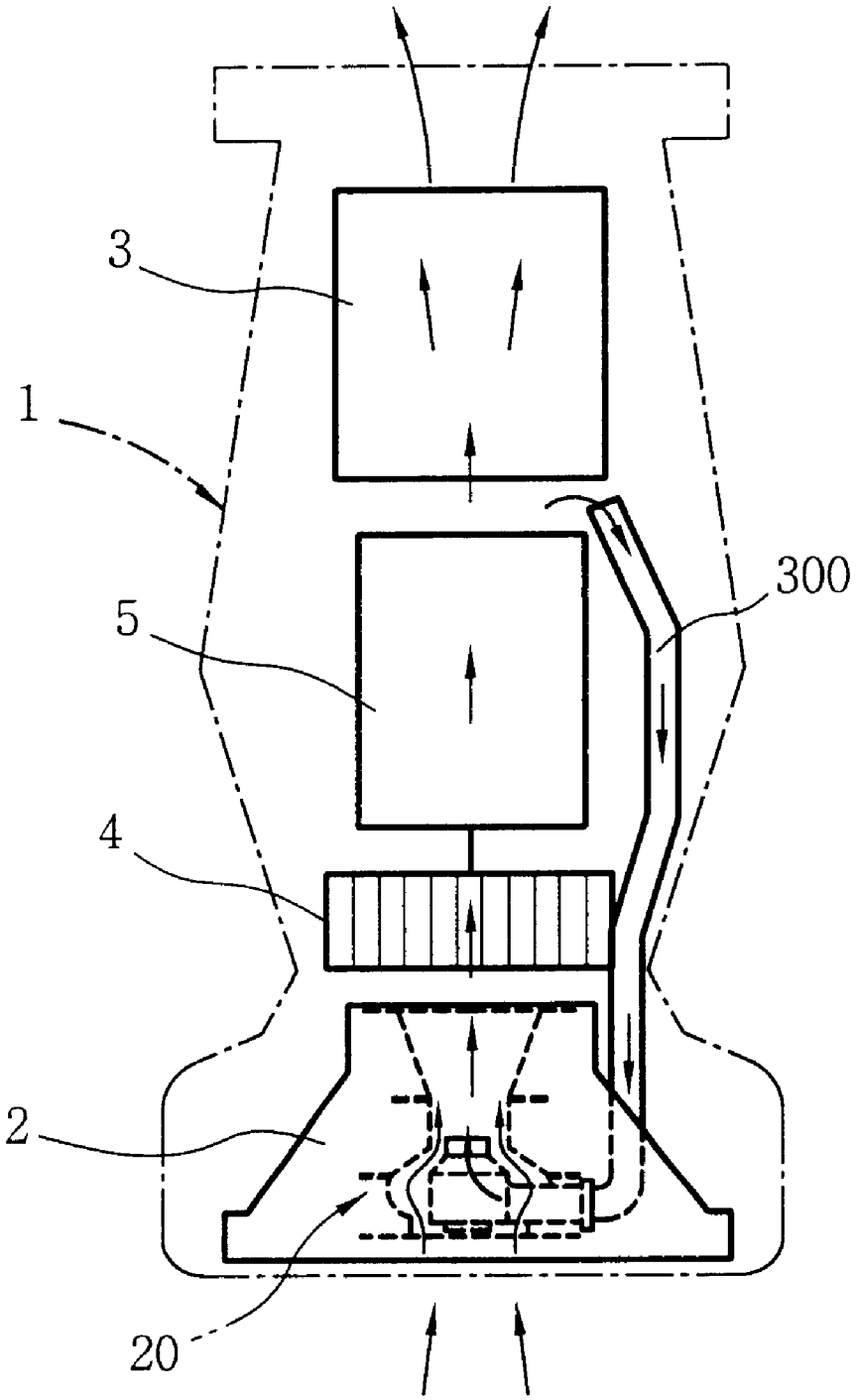
FIG. 6 is a schematic view illustrating the another embodiment of the flow channel system of the one-bodied vacuum cleaner according to the present invention.

As depicted in FIG. 5, in the another embodiment of the present invention, the ejector 20 arranged on the outlet end of the reflux pipe 200 can be placed inside of the suction blower 2, in this case the longitudinal dimension of the suction blower 2 increases a little, but the vertical length where the ejector 20 is placed is removed, accordingly the length of the vacuum cleaner is shorter. In addition, in this case, as depicted in FIG. 6, it is advisable to minimize the flow resistance of the discharge air by reducing the length of the reflux pipe 300 by arranging the suction fan 4 including the fan motor 5 on the outlet side of the suction blower 2 consecutively and the dust collect filter 3 on the discharge side of the suction fan 4.

Figure 7:
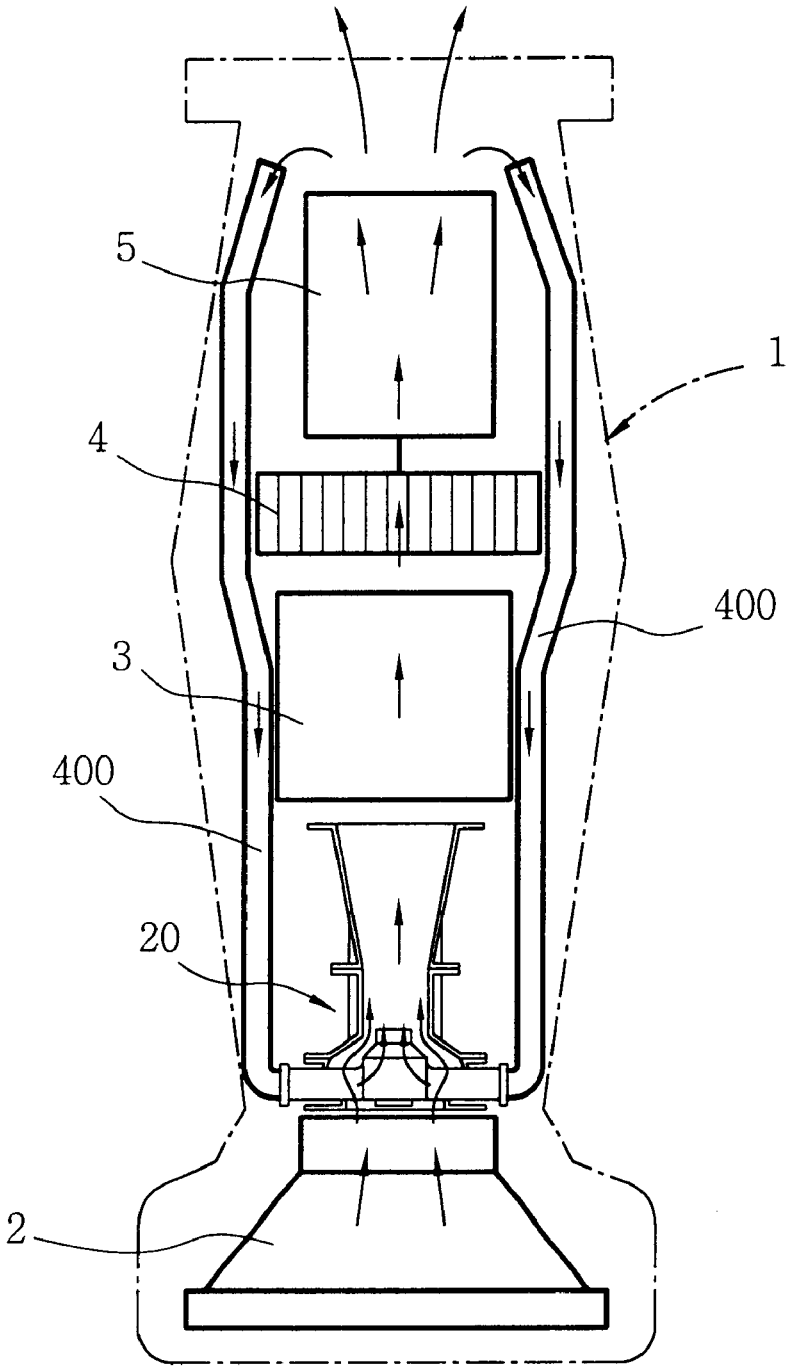
FIG. 7 is a schematic view illustrating the another embodiment of the flow channel system of the one-bodied vacuum cleaner according to the present invention.
Figure 8:
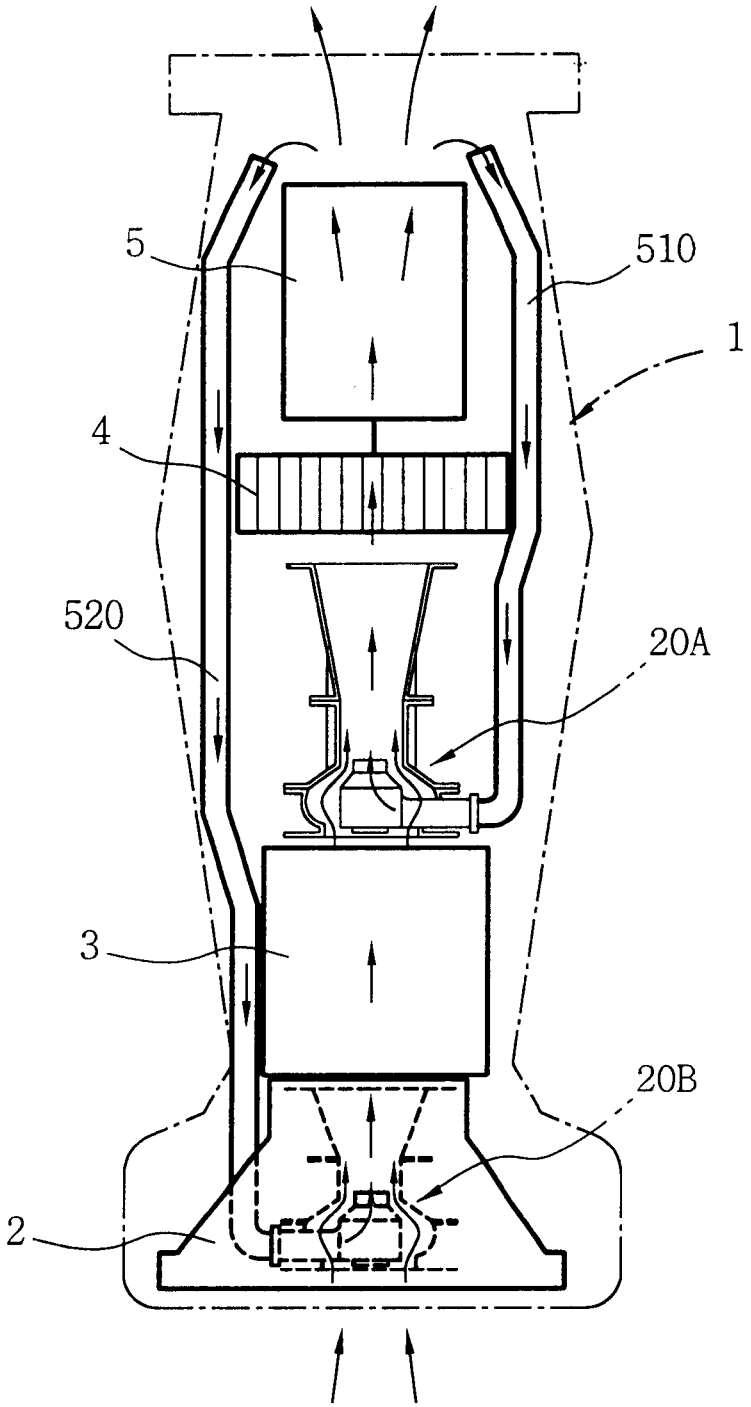
FIG. 8 is a schematic view illustrating the another embodiment of the flow channel system of the one-bodied vacuum cleaner according to the present invention.

As depicted in FIG. 7, in the another embodiment of the present invention, when there is a plurality of the reflux pipes 400, the inlet end of the each reflux pipe is placed on the discharge side of the suction fan 4, the all outlet ends of the plurality of the reflux pipes 400 are connected with the one ejector, or as depicted in FIG. 8, the ejectors 20*a,* 20B connected with the outlet end of the each reflux pipe 510, 520 are placed on the different portion each other such as between the suction blower 2 and dust collect filter 3 or between the dust collect filter 3 and suction fan 4 or inside of the suction blower 2 ect.

As described above, the each embodiment according to the present invention can be adapted more effectively to the one-bodied vacuum cleaner comprising a suction unit and a motor unit in the same casing, but it can be adapted also to a separation type vacuum cleaner comprising the suction unit and motor unit separately in different casings.

What is claimed is:

1. An air circulation type vacuum cleaner, comprising:

a casing having a suction port and an exhaust port;

a suction blower having an inlet and an outlet, wherein the inlet is placed on the suction port of the casing to intake air with impurities through the suction port of the casing;

a suction fan having an inlet and an outlet;

a dust collecting filter, wherein the filter is placed after the outlet of the suction blower, and wherein the dust collecting filter removes a portion of the impurities from the air;

at least one reflux pipe with an inlet and an outlet, wherein the inlet of the reflux pipe is placed on the outlet side of the suction fan and wherein the outlet of the reflux pipe is arranged to return air discharged from the outlet side of the suction fan to the inlet side of the suction fan; and at least one ejector installed on the outlet side of the at least one reflux pipe, wherein the at least one ejector is configured to discharge air towards the suction fan to thereby increase a suction of the vacuum cleaner.

2. The air circulation type vacuum cleaner according to claim 1, wherein the outlet end of the ejector is placed between the suction port of the casing and dust collecting filter.

3. The air circulation type vacuum cleaner according to claim 1, wherein the outlet end of the ejector is placed between the dust collecting filter and the suction fan.

4. The air circulation type vacuum cleaner according to claim 1, wherein the ejector is arranged inside of the suction blower.

5. The air circulation type vacuum cleaner according to claim 4, wherein the suction fan is placed on the outlet side of the suction blower, and wherein the dust collecting filter is placed on the outlet side of the suction fan.

6. The air circulation type vacuum cleaner according to claim 1, wherein the inlet end of the reflux pipe is placed on the outlet side of the suction fan and the ejector is placed between the suction blower and dust collecting filter, or between the dust collecting filter and the suction fan.

7. The air circulation type vacuum cleaner according to claim 1, wherein the reflux pipe is formed so as to have the same diameter from the inlet end to the outlet end.

8. The air circulation type vacuum cleaner according to claim 7, wherein the reflux pipe comprises a flow channel groove having a spiral shape on the inner circumference.

9. The air circulation type vacuum cleaner according to claim 1, wherein the reflux pipe is formed such that its diameter becomes smaller from the inlet end to the outlet end.

10. The air circulation type vacuum cleaner according to claim 9, wherein the reflux pipe comprises a flow channel groove having a spiral shape on the inner circumference.

11. An air circulation type vacuum cleaner, comprising:

a casing having a suction port and an exhaust port;

a suction blower having an inlet and an outlet, wherein the inlet is placed on the suction port of the casing to intake air with impurities through the suction port of the casing;

a fan having an inlet and an outlet wherein the fan provides a suction force;

a dust collecting filter positioned after the outlet of the suction blower;

at least one reflux pipe with an inlet and outlet, wherein the inlet is located on the outlet side of the fan and is configured to return air discharged from the outlet side of the fan to the inlet side of the fan; and at least one ejector coupled to the outlet of the at least one reflux pipe, wherein the ejector is placed either between the dust collecting filter and the fan, or between the suction blower and the dust collecting filter.

12. The air circulation type vacuum cleaner according to claim 11, wherein the at least one ejector is located between the dust collecting filter and the fan.

13. The air circulation type vacuum cleaner according to claim 11, wherein the at least one ejector is located between the suction blower and the dust collecting filter.

14. The air circulation type vacuum cleaner according to claim 11, wherein the reflux pipe is formed so as to have the same diameter from the inlet end to the outlet end, and wherein a flow channel groove having a spiral shape is formed on an inner circumference of the reflux pipe.

15. The air circulation type vacuum cleaner according to claim 11, wherein the at least one reflux pipe comprises a first reflux pipe and a second reflux pipe, wherein the at least one ejector comprises a first ejector coupled to the outlet of the first reflux pipe and a second ejector coupled to the outlet of the second reflux pipe, and wherein the second ejector is located downstream of the first ejector.

16. An air circulation type vacuum cleaner, comprising:

a casing having a suction port and an exhaust port;

a suction blower having an inlet and an outlet, wherein the inlet is placed on the suction port of the casing to intake air with impurities through the suction port;

a suction fan having an inlet and an outlet, and wherein the suction fan provides a suction force;

a dust collecting filter, wherein the filter is located after the outlet of the suction blower, and wherein the dust collecting filter removes a portion of the impurities from the air; and at least one reflux pipe with an inlet and outlet, wherein the inlet is placed on the outlet side of the suction fan and is configured to return air discharged from the outlet side of the suction fan to the inlet side of the suction fan and wherein the reflux pipe comprises a flow channel groove having a spiral shape on an inner circumference of the reflux pipe.

17. The air circulation type vacuum cleaner according to claim 16, further comprising at least one ejector installed on the outlet side of the at least one reflux pipe, and wherein a diameter of the reflux pipe becomes smaller from the inlet end to the outlet end.

18. A vacuum cleaner, comprising:

a casing having a suction port and an exhaust port;

a suction blower formed on an outlet portion of the suction port;

a dust collecting filter located after an outlet portion of the suction blower;

a fan configured to provide a suction force that draws air into the suction port;

a reflux pipe with an inlet end of the reflux pipe near an outlet portion of the fan; and an ejector connected to an outlet end of the reflux pipe, wherein the ejector is placed either between the suction blower and the dust collecting filter, or between the dust collecting filter and the fan.

19. The vacuum cleaner according to claim 18, wherein the ejector is inside the blower, and wherein the dust collecting filter is placed on the outlet side of the fan.

20. The vacuum cleaner according to claim 18, wherein a flow channel groove having a spiral shape is formed on an inner circumference of the reflux pipe.

21. The vacuum cleaner according to claim 18, wherein the reflux pipe comprises a first reflux pipe, and further comprising a second reflux pipe with an inlet end near the outlet portion of the fan.

22. The vacuum cleaner according to claim 21, wherein the ejector is connected to the outlet end of the first and second reflux pipes.

23. The vacuum cleaner according to claim 21, further comprising a second ejector connected to an outlet end of the second reflux pipe.

24. The vacuum cleaner according to claim 18, wherein the ejector is configured to eject air from the reflux pipe in a direction substantially parallel to a direction of air moving through the suction blower.

25. A vacuum cleaner, comprising:

a casing having a suction port and an exhaust port;

a dust collecting filter located after an outlet portion of the suction port;

a fan configured to provide a suction force that draws air into the suction port;

a reflux pipe having an inlet end near an outlet portion of the fan; and an ejector connected to an outlet end of the reflux pipe, wherein the ejector ejects air from the reflux pipe towards the fan to increase a suction force of the vacuum cleaner.

* * * * *